US005222464A

United States Patent [19]

Oyaizu

[11] Patent Number: 5,222,464

[45] Date of Patent: Jun. 29, 1993

[54] FOUR CYCLE ENGINE

[75] Inventor: Takeshi Oyaizu, Iwata, Japan

[73] Assignee: Yamaha Hatsudoki Kabushiki Kaisha, Iwata, Japan

[21] Appl. No.: 753,968

[22] Filed: Sep. 3, 1991

[30] Foreign Application Priority Data

Sep. 4, 1990 [JP] Japan ..... 2-235267

[51] Int. Cl.[5] ..... F02F 1/36

[52] U.S. Cl. ..... 123/41.82 R; 29/888.01

[58] Field of Search ..... 123/41.72, 41.74, 41.82 R, 123/193 H, 432; 29/888.01

[56] References Cited

U.S. PATENT DOCUMENTS 2,710,602 6/1955 Maybach ..... 123/41.82 R 4,877,004 10/1989 Nishizawa ..... 123/432

OTHER PUBLICATIONS

Europaische Patentanmeldung No. EP 0 282 808 A2 dated Sep. 21, 1988.

Europaische Patentanmeldung No. EP 0 238 879 A2 dated Sep. 30, 1987.

*Primary Examiner*—Noah P. Kamen

*Attorney, Agent, or Firm*—Ernest A. Beutler

[57] ABSTRACT

A V-type liquid cooled engine having overhead cam shafts and a plurality of intake and exhaust ports. The cylinder head cooling jacket is formed by a central portion and side portions which are separated from each other by internal walls that define in part the intake and exhaust ports, respectively. A drilled opening is formed in the upper portion of the highest wall so as to facilitate coolant flow and air purging.

20 Claims, 6 Drawing Sheets

FOUR CYCLE ENGINE

BACKGROUND OF THE INVENTION

This invention relates to a four cycle engine and more particularly to an improved cooling structure for the cylinder head of such an engine.

The use of overhead valves is well known in four cycle engines to improve their efficiency and performance. In fact, it is now the practice to employ multiple intake and exhaust valves for the purpose of performance and efficiency improvement. Normally, the intake ports are formed on one side of the cylinder head and the exhaust ports are formed on the other side of the cylinder head. This has the natural tendency to divide the cooling jacket of the cylinder head into a central portion formed above the combustion chamber and between the intake and exhaust ports and side portions positioned outwardly of the respective ports on their sides of the cylinder head. With such an arrangement, it is necessary to insure that there is good flow of liquid coolant between the center and side cooling jacket portions. Furthermore, it is desireable to insure that there will be no areas where the coolant flow is stagnant and wherein air might become trapped. This problem is particularly acute when the engine is provided with non-vertically oriented cylinder bores such as with inclined engines, V-type or opposed engines.

The problem of providing good coolant flow and the avoidance of air pockets in the cylinder head cooling jackets is particularly acute when multiple ports are employed. Where multiple ports are employed, they normally share a common wall that tends to further isolate the side cooling jackets from the center cooling jacket. This can be a particular problem particularly when one of the side cooling jackets is inclined and higher than the central cooling jacket. When this occurs, there is the likelihood that air may be entrapped in this elevated portion of the cooling jacket and cooling efficiency can be significantly deteriorated.

It is, therefore, a principal object to this invention to provide an improved cooling jacket arrangement for the cylinder head of an engine and particularly useful with engines having multiple intake and exhaust ports.

It is a further object to this invention to provide an improved cooling jacket arrangement for an internal combustion engine cylinder head that will insure against the entrapment of air in elevated portions of the cooling jacket.

It is a further object to this invention to provide an improved arrangement for providing water passages between the cylinder head cooling jacket portions that can be easily formed and which will insure good coolant flow and air purging.

SUMMARY OF THE INVENTION

This invention is adapted to be embodied in a cylinder head assembly for a liquid cooled internal combustion engine which defines in part a combustion chamber. Exhaust port means extend from the combustion chamber through one side of the cylinder head and terminate in exhaust outlet means in the outer surface of the cylinder head. Intake port means are formed in the cylinder head and extend from intake inlet means formed in an outer surface of the cylinder head to the combustion chamber. The intake port means and the exhaust port means are each defined by respective internal walls of the cylinder head. A cooling jacket is formed in the cylinder head and is comprised of an exhaust side formed in the one side of the cylinder head and defined in part by the exhaust internal wall, a central portion formed between the intake and exhaust port means and defined by at least in part by their respective walls and an intake side portion formed on the other side of the cylinder head and defined in part by the intake port internal wall. In accordance with the invention, means are provided for communicating the intake side portion and exhaust side portion of the cylinder head cooling jacket with the central portion and includes at least one passage formed in an upper part of the internal wall of one of the port means.

DETAILED DESCRIPTION OF THE PREFERRED EMBODIMENT OF THE INVENTION

Figure 1:
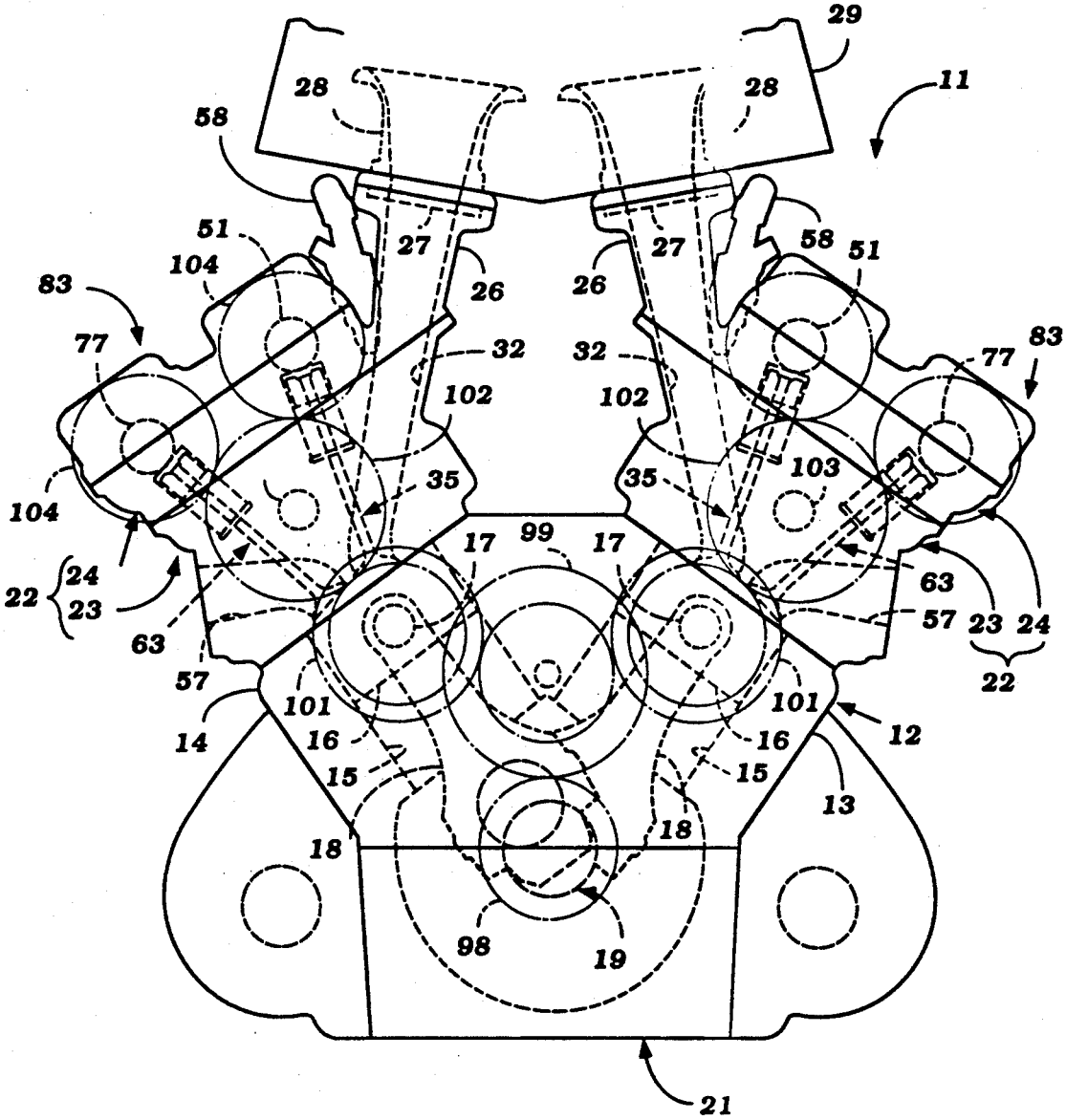
FIG. 1 is a front elevational view of an internal combustion engine constructed in accordance with an embodiment of the invention.

Referring now in detail to the drawings and initially primarily to FIG. 1, a water cooled, four cycle internal combustion constructed in accordance with an embodiment of the invention is depicted and is identified generally by the reference numeral 11. In the illustrated embodiment, the engine 11 is depicted as being of the V-type although is should be readily apparent to those skilled in the art that the invention can be practiced with engines have other than a V-type configuration. However, the invention has particularly utility in engines where the cylinder heads are not disposed in a normal horizontal condition, as with vertically oriented cylinder bores.

The engine 11 includes a cylinder block 12 having a pair of inclined cylinder banks 13 and 14, each of which is formed with one or more cylinder bores 15. Pistons 16 are supported for reciprocation within the cylinder bores 15 and are connected by means of piston pins 17 to the small end of connecting rods 18 in a well known manner. The lower ends of the connecting rods 18 are journalled, in paired fashion, on journal portions of a crankshaft, indicated generally by the reference numeral 19.

The crankshaft 19 is journalled for rotation in a well known manner and is contained within a crankcase assembly formed by the lower portion of the cylinder block 12 and a crankcase 21 which is affixed to the cylinder block 12 in a known manner. Since the invention deals primarily with the cylinder head assembly for the engine 11, further description of the cylinder block 12, components contained therein and the crankcase 21 are not believed to be necessary to understand the invention. For that reason, further description of these components will not be included.

Referring now additionally to the remaining figures, a cylinder head assembly 22 is affixed to each of the cylinder banks 13 and 14 in a suitable manner. Each cylinder head assembly 22 is comprised of a two part construction consisting of a lower or main head portion 23 and an upper, cam carrier portion 24. The portions 23 and 24 may be affixed to each other in a suitable manner.

The center or valley side of each cylinder head assembly 22 comprises the intake side and there is provided a siamese type of intake passage on this side of each cylinder head assembly 22 that is comprised of a generally oval shaped intake opening 25 which is formed in an inner wall 26 of the cam carrier portion 24. A slide type throttle valve assembly 27 is slideably supported in this intake portion 25 in a suitable manner and is served by an inlet air trumpet 28 that extends into an air box or plenum chamber 29 which receives atmospheric air in a suitable manner.

From the oval inlet opening 25, the intake port extends downwardly toward a combustion chamber 31 formed by individual recesses in the lower face of the cylinder head assembly 22 and specifically the head portion 23. The intake port divides into individual intake passages 32 each of which terminates at a respective intake port 33 formed by a valve insert 34 pressed or cast into the cylinder head portion 23 in the combustion chamber 31.

Figure 2:
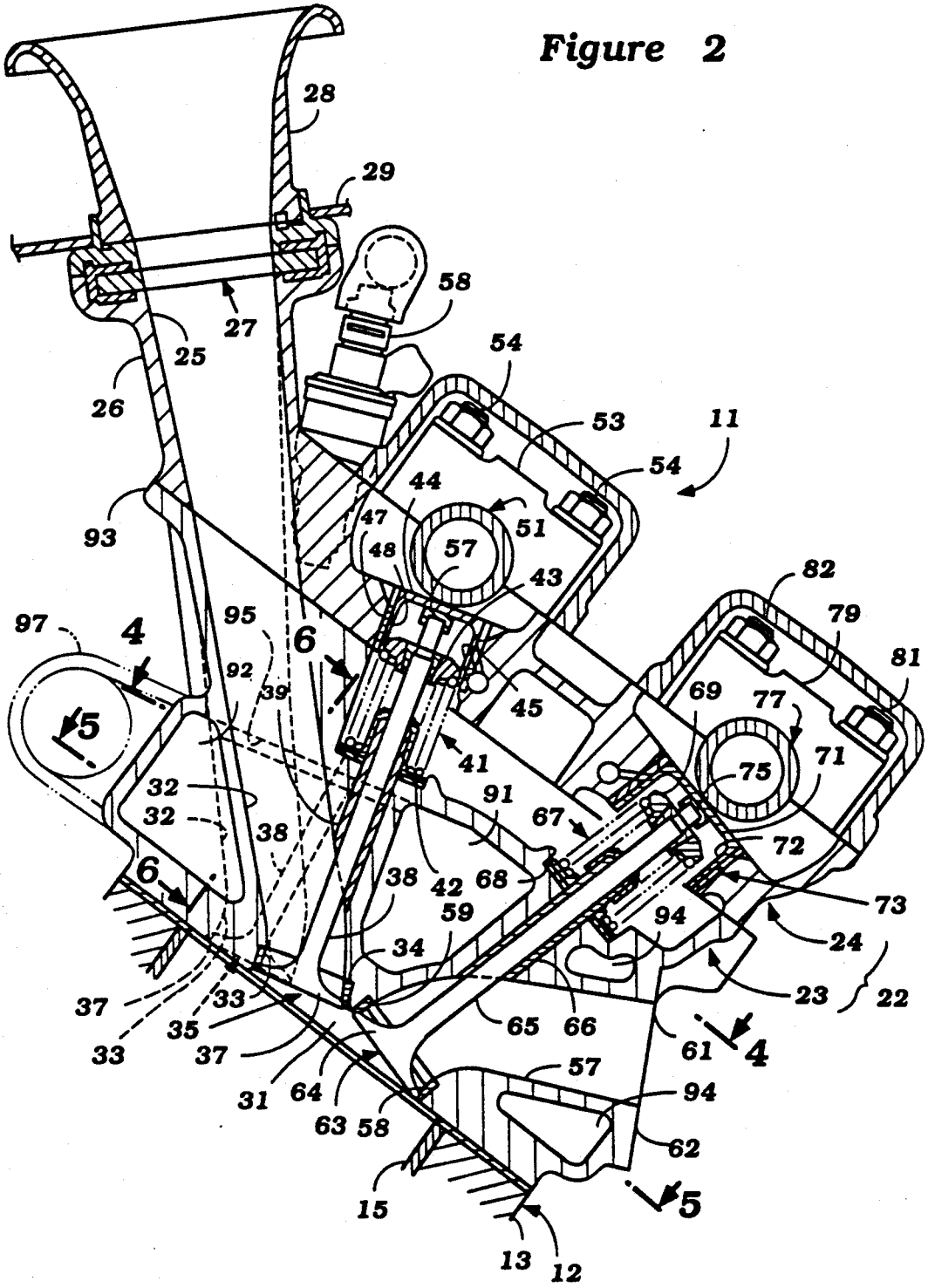
FIG. 2 is an enlarged cross-sectional view taken through the cylinder head and upper portion of the cylinder bore of the right hand bank of the engine.

A respective intake valve 35 controls the communication of each intake port 33 with the combustion chamber 31. The intake valves 35, there being three for each combustion chamber 31 or cylinder 15, are disposed as generally described in U.S. Pat. No. 4,660,529, entitled "Four-Cycle Engine", issued Apr. 28, 1987 in the name of Masaaki Yoshikawa, and assigned to the assignee hereof. Basically, the intake valves 35 are supported for reciprocation, in a manner to be described, about respective axes that inclined at acute angles to a plane containing the axis of the cylinder bore 15 and extending perpendicularly to the plane of FIG. 2. One, the center, of the intake valves 35 is disposed at a lesser acute angle then the remaining two intake valves 35, which generally are reciprocal along axes that are parallel to each other and lie within a common plane. Of course, other types of relationships may be employed and the invention can be utilized in conjunction with engines having other than three intake valves. However, the invention has particular utility in engines having three or more intake valves wherein the intake passages are defined in part by a common internal wall of the cylinder head assembly, this wall being identified generally by the reference numeral 36 in the figures.

Each of the intake valves 35 is of the poppet type and includes a head portion 37 which cooperates with the respective valve seat 33 for controlling the communication of the combustion chamber 31 with the intake ports formed by the portions 32 and 25. In addition, each valve 35 has a stem portion 38 which is slideably supported within a respective valve guide 39 that is pressed or cast into the cylinder head assembly 22 and specifically the main cylinder head portion 23.

A spring assembly, indicated generally by the reference numeral 41 and comprised of a pair of concentric coil springs is provided for urging each intake valve 35 to its closed portion. The spring assembly 41 bears against a(bearing surface 42 provided by an upper surface of the cylinder head portion 23 and a spring retainer 43 that is affixed in a known manner, as by means of a keeper to the upper portion of the respective valve stem 38.

The intakes valves 35 are each operated by a respective tappet 44 which is slideably supported, in a manner to be described, in the cam carrier portion 24 of the cylinder head assembly 22. It should be noted that the outer diameter of the intake valve spring assembly 41 is substantially equal to the diameter of the tappet 44 and thus, only the retainer 43 extends into an internal bore 45 of the tappet 44.

Figure 3:
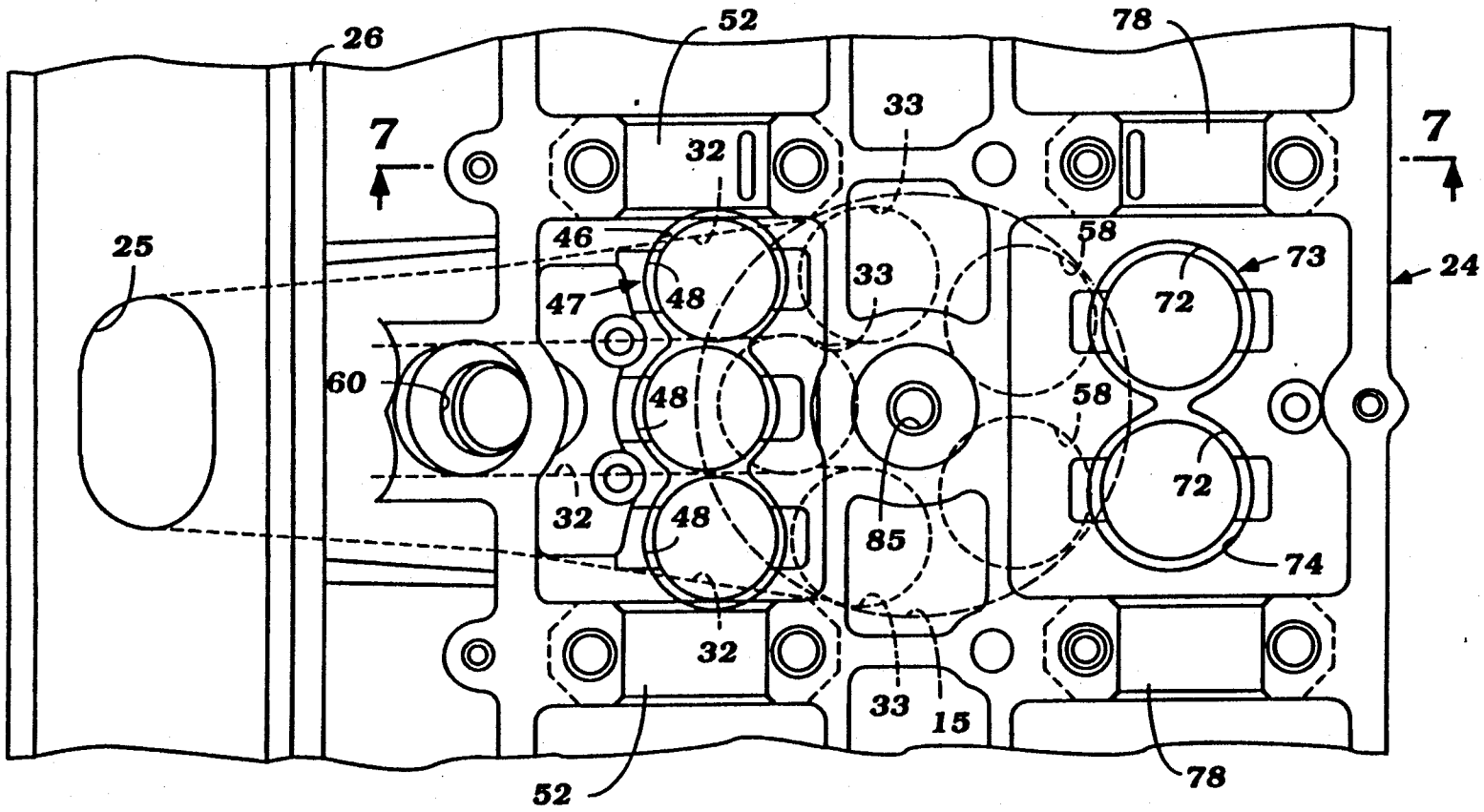
FIG. 3 is a top plan view of a portion of the right hand bank cylinder head assembly with the cam shafts, cam covers and cam bearing caps removed.

It should be noted from FIG. 3 that the cylinder head portion 24 is provided with a single opening 46 that receives a common insert piece 47 that defines bores 48 in which the respective tappets 44 reciprocate. This permits the tappets 44 to be positioned quite close to each other and still permits a high strength for the cylinder head portion 24.

Figure 7:
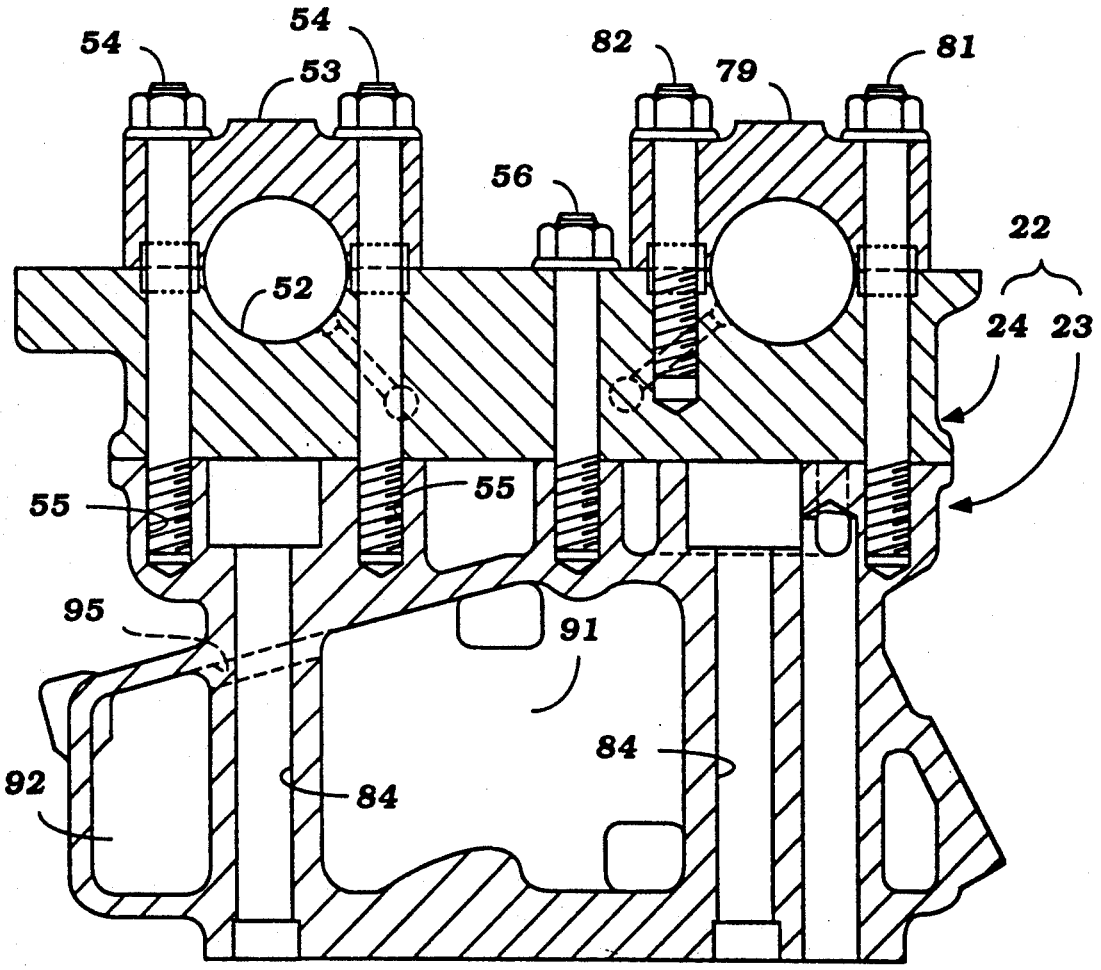
FIG. 7 is an enlarged cross-sectional view taken along the line 7—7 of FIG. 3.

An intake cam shaft 51 is rotatably journalled within the cam carrier portion 24 of the cylinder head assembly 22 by means of bearing surfaces 52 formed on opposite sides of the tappet supporting insert 47. Bearing caps 53 are affixed to the cam carrier portion 22 for each bearing surface 52 by means of studs 54 which extend through the bearing caps 53, cam carrier portion 24 and are threaded into tapped openings 55 formed in the main cylinder head portion 23 (FIG. 7). This provides a portion of the means by which the cylinder head portion 24 and 23 are affixed to each other. Further studs 56 also secure directly the portions 24 and 23 to each other and do not cooperate with the bearing caps 53.

The intake cam shaft 51 has respective lobes that cooperate with the tappets 44 so as to operate the intake valves 35 in a known manner. Adjusting shims 57 are interposed between the ends of the valves stems 38 and the tappets 44 for clearance adjustment. The intake cam shafts 51 are driven in a manner which will be described.

Fuel injectors 58 are mounted in the cylinder head assembly 22 in pocket 60 on the intake side thereof and spray fuel into the intake passages formed by the inlet portions 25 and portions 32. The fuel injectors 58 are operated and controlled in suitable manner.

Figure 4:
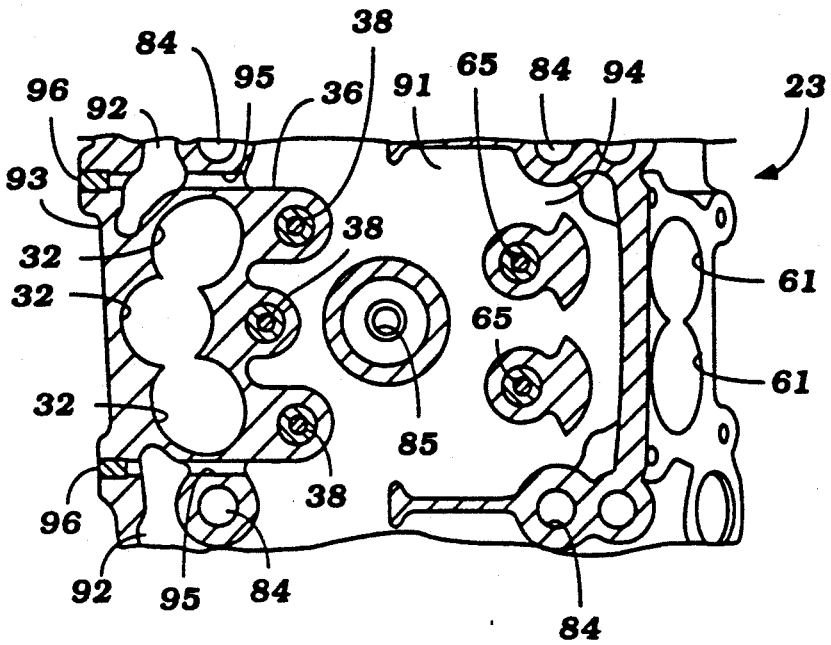
FIG. 4 is a cross-sectional view taken along the line 4—4 of FIG. 2.

A pair of exhaust passages 59 extend from exhaust ports 58 formed by valve inserts 59 through the exhaust side of the engine and terminate in outlet openings 61. The openings 61 are partially siamesed as shown in FIG. 4 and formed in a side surface 62 of the cylinder head portion 23. In the illustrated embodiment, there are two exhaust passages 57 for each combustion chamber 31. Of course, the invention can be employed in conjunction with a different number of exhaust passages but the invention has particular utility where there are a lesser number of exhaust passages than intake passages.

Poppet type exhaust valves 63 have head portions 64 that cooperate with the exhaust ports 58 for controlling the flow of exhaust gases from the combustion chamber 31. As described in aforenoted U.S. Pat. No. 4,660,529, the exhaust valves 63 may supported for reciprocation along parallel axes which lie at a common plane that is disposed at an acute angle to the aforenoted plane containing the axis of the cylinder bore 15 and which acute angle is less than the acute angle of the side intake valves 35 and greater than the acute angle of the center intake valve 35. It should be noted that the heads of the exhaust valves 64 lie on the exhaust side of the aforenoted plane when the exhaust valves 63 are closed while the heads 37 of the intake valves 35 lie substantially on the other side of this plane. The heads of the side intake valves, however, extends slightly over this plane.

The exhaust valves 63 have stem portions 65 that are slideably supported within valve guides 66 that are pressed or cast into the cylinder head portion 23. The exhaust valves 63 are urged to their closed positions by means of a spring assembly 67 that includes a pair of concentric coil springs. The spring assembly 67 bears against a bearing surface 68 formed on the upper side of the cylinder head portion 23. The other ends of the springs of the spring assembly 67 bear against a keeper retainer assembly 69 that is affixed to the upper end of the valve stems 65.

A bucket type tappet assembly 71 is provided for operating each of the exhaust valves 63. Each bucket tappet 71 is slideably supported within a respective bore 72 formed by a common insert piece 73 that is inserted into the cam carrier 24 and specifically an opening 74 having generally the shape of a figure eight. This construction, like that associated with the intake valve tappets 44, provides a stronger head assembly and yet permits close placement of the exhaust tappets 71 to each other.

It should be noted that the diameter of the exhaust valve spring assembly 68 is smaller than the diameter of the bucket tappets 71 and, accordingly, the keeper 69 extends to the upper end of the bucket tappets 71. Adjusting shims 75 are interposed between the ends of the valve stems 65 and the bucket tappets 71 for clearance adjustment.

Figure 5:
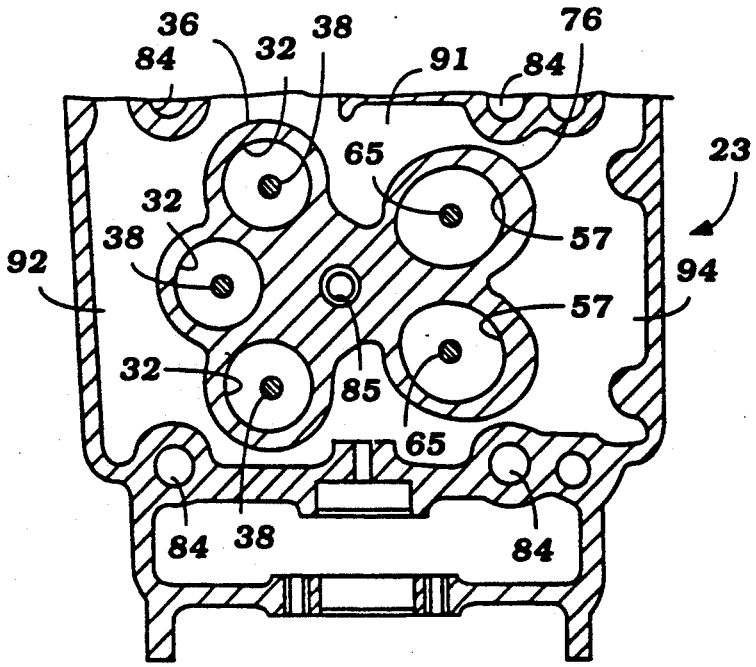
FIG. 5 is a cross-sectional view taken along the line 5—5 of FIG. 2.

It should be noted that the exhaust passages 57 are formed at least in part by a common wall which appears in FIG. 5 and is identified generally by the reference numeral 76.

The exhaust valves 63 and specifically their actuating tappets 71 are operated by means of an exhaust cam shaft 77. The exhaust cam shaft 77, like the intake cam shaft 55 is rotatably journalled within a pair of bearing surfaces 78 (FIG. 3) formed on opposite sides of each of the tappets supporting inserts 73. Bearing caps 79 are affixed thereto by means of longer studs 81 which, like the intake cam shaft studs 54, extend through the cam carrier 24 and are threaded into the cylinder head main portion 23 (FIG. 7). In addition, shorter studs 82 extend through the bearing caps 79 and are threaded into tapped openings in the cam carrier portion 24 so as to complete the attachment of the bearing caps 79 to the cylinder head assembly.

The exhaust cam shaft 77 is driven in a manner which will be described. The intake and exhaust cam shafts 51 and 77 for each cylinder head assembly 22 are enclosed within a cam cover 83 that is affixed to the cylinder head assembly 22 in any suitable manner.

Figure 6:
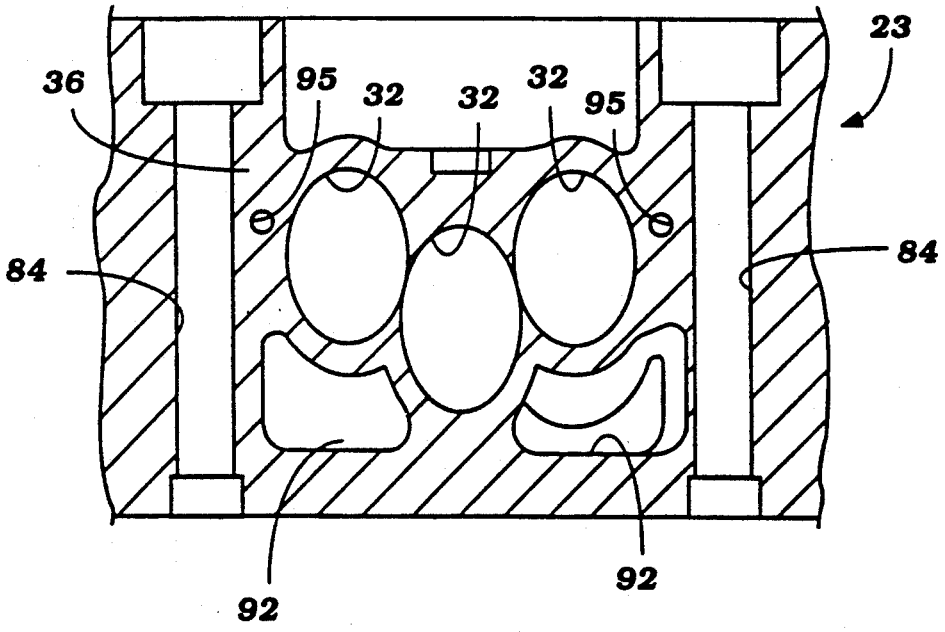
FIG. 6 is a cross-sectional view taken along the line 6—6 of FIG. 2.

As may be seen in FIGS. 4 through 6, the internal walls 36 and 76, which form the intake and exhaust ports are formed with bored openings 84 that are adapted to receive fasteners for securing the cylinder head assembly 22 to the cylinder block 12. In addition, these walls merge at a central portion of the cylinder head portion 23 adjacent the combustion chamber 31 and define a spark plug receiving opening 85 which is generally centrally disposed in the combustion chamber for receiving a spark plug (not shown) for each cylinder to fire the charge therein in a well known manner.

The engine 11 is water cooled and to this end the cylinder block 12 is provided with a cooling jacket (not shown) through which water is circulated by a coolant pump, which is also not shown. Each cylinder head assembly 22 is provided with a cooling jacket that is defined by three portions. These portions comprise a central portion 91 which is defined generally adjacent the combustion chamber 31 and between the intake wall 36 and the exhaust wall 76. In addition, there is provided an intake cooling jacket portion 92 that is formed on the valley side of the cylinder head assembly 22 and primarily defined by the wall 36 and the outer surface or outer wall 93 of the cylinder head portion 23. There is further provided an exhaust jacket portion 94 that is defined between the wall portion 62 of the cylinder head portion 23 and the exhaust wall 76.

Because of the fact that the exhaust spring bearing surface 68 is disposed at a higher level than the intake spring bearing surface 42, the exhaust jacket portion 94 is higher than the intake portion 92. This insures better cooling of the more highly heated exhaust side of the cylinder head assembly 22. For this same reason, cooling water is delivered to the cylinder head cooling jacket from the cylinder block cooling jacket first through the exhaust cooling jacket portion 94 through passages (not shown).

This cooling water then flows to the central cylinder head cooling jacket portion 91 and it will be seen that the wall 76 is substantially interrupted due to the fact that there are only two exhaust passages 57 so as to insure good coolant flow. However, the communication with the intake cooling jacket portion 92 is more restricted due to the fact that there are more intake passages than exhaust passages. Furthermore, since the cylinder head assembly 22 is inclined due to the V shape of the engine, the upper portion of the intake cooling jacket portion 32 can form air pockets which could adversely effect the cooling.

In order to provide good water communication and air purging, communication passageways, indicated by the reference numerals 95 are formed in the wall 36. In accordance with a feature of the invention, the passageways 95 may be conveniently formed by drilling them from the exterior surface 93 of the cylinder head portion 23 as may be best seen in FIG. 4. The outer wall 93 of the cylinder head portion 23 will be drilled, but this drilled opening is then closed by plugs 96 so as to maintain integrity of the cooling jacket. However, because of the drilled arrangement it is possible to conveniently form the water flow passages which will not only circulate the coolant from the cylinder head cooling jacket central portion 91 to the intake portion cooling jacket 92 but which will also permit air to be purged from the system.

A discharge port 97 is formed at one end of the cylinder head portion 23 and communicates with the intake side cooling jacket portion 92 for discharge of the coolant from the cylinder heads 22.

As may be seen in FIG. 5, at the lower portion of the cylinder head assembly 22, coolant may easily flow from the central portion 91 to the intake portion 92 around the outer periphery of the wall 36. It is only at the upper portion where the drilled passages 95 are provided that a problem would occur but for the passages 95.

The drive for the cam shafts 51 and 57 of each cylinder bank will now be described by reference to FIG. 1. This drive is comprised of a gear train that is a comprised of a first drive gear 98 that is affixed to the crankshaft 91 and which meshes with an intermediate drive gear 99 rotatably journalled at one end of the cylinder block 12 in appropriate manner. The gear 99 meshes with a pair of gears 10 journalled on opposite sides of the cylinder block 12 adjacent the banks 13 and 14. These gears 101 mesh with gears 102 journalled on shafts 103 that are supported in the cylinder head portions 23. The gears 102 mesh with gears 104 fixed to the intake and exhaust cam shafts 51 and 77 of the respective cylinder head assemblies. This gear train comprised of the gears 98, 99, 101, 102 and 104 drives the cam shafts 51 and 77 at one half crankshaft speed, for reasons well known in this art.

It should be readily apparent from the foregoing description that the described cooling jacket construction provides a very effective cooling of the cylinder heads of a multiple port cylinder head assembly and which will also insure good purging of any air contained within the cylinder head cooling jackets even though the cylinder heads are disposed at an inclined angle. Of course, the foregoing description is that of a preferred embodiment of the invention and various changes and modifications may be made without departing from the spirit and scope of the invention, as defined by the appended claims.

I claim:

1. A cylinder head assembly for a liquid cooled internal combustion engine, said cylinder head assembly defining in part a combustion chamber, exhaust port means extending from said combustion chamber through one side of said cylinder head and terminating in exhaust outlet means in one outer surface thereof, intake port means formed in the other side of said cylinder head assembly and extending from intake inlet means formed in an outer assembly thereof to said combustion chamber, said intake port means and said exhaust port means each being defined by respective internal walls of said cylinder head, a cooling jacket formed in said cylinder head and comprised of a central portion defined between said walls and in proximity to said combustion chamber, an inlet side portion formed between said intake port means wall and said other side of said cylinder head and an exhaust side portion formed in part by said exhaust port means wall and said one side of said cylinder head, and means for communicating said cooling jacket portions with each other comprising at least one opening formed in one of said walls, said opening being formed in an upper portion of said one wall for assisting in purging air from said cooling jacket by permitting air in an upper part of said central portion to pass to the adjacent side portion, said opening being formed in said one wall by a machining operation.

2. A cylinder head assembly as set forth in claim 1 wherein the opening is machined by passing a tool through an opening in an outer surface of the respective side of the cylinder head, which outer surface opening is subsequently closed.

3. A cylinder head assembly as set forth in claim 1 wherein the cylinder head cooling jacket portions are formed so that the portion that communicates with the central portion through the opening is disposed above the central portion.

4. A cylinder head assembly as set forth in claim 3 wherein the cylinder head is inclined so as to position the one portion above the central portion.

5. A cylinder head assembly as set forth in claim 4 wherein the opening is machined by passing a tool through an opening in an outer surface of the respective side of the cylinder head, which outer surface opening is subsequently closed.

6. A cylinder head assembly as set forth in claim 1 wherein the intake port means and the exhaust port means each comprise plural intake and exhaust ports.

7. A cylinder assembly as set forth in claim 6 wherein the plural ports are all formed at least in part by a common wall other than that portion that forms the combustion chamber.

8. A cylinder head assembly as set forth in claim 7 wherein the opening is machined by passing a tool through an opening in an outer surface of the respective side of the cylinder head, which outer surface opening is subsequently closed.

9. A cylinder head assembly as set forth in claim 8 wherein the cylinder head cooling jacket portions are formed so that the portion that communicates with the central portion through the opening is disposed above the central portion.

10. A cylinder head assembly as set forth in claim 9 wherein the cylinder head is inclined so as to position the one portion above the central portion.

11. A cylinder head assembly as set forth in claim 10 wherein at least one of the port means is comprised of three ports and the opening is formed in the wall that defines the three ports.

12. A cylinder head assembly as set forth in claim 6 wherein at least one of the port means is comprised of three ports and the opening is formed in the wall that defines the three ports.

13. A cylinder head assembly as set forth in claim 1 wherein coolant is delivered to the exhaust cooling jacket portion from a cylinder block and flows from the exhaust cooling jacket portion to the central cooling jacket portion and then to the intake cooling jacket portion for discharge from the cylinder head and wherein the opening is formed in the intake port internal wall.

14. A cylinder head assembly as set forth in claim 13 wherein there are provided more intake ports by the intake port means than exhaust ports by the exhaust port means.

15. A cylinder head assembly as set forth in claim 14 wherein there are at least three intake ports.

16. A cylinder head assembly as set forth in claim 15 wherein the opening is machined by passing a tool through an opening in an outer surface of the respective side of the cylinder head, which outer surface opening is subsequently closed.

17. A cylinder head assembly as set forth in claim 16 wherein the cylinder head cooling jacket portions are formed so that the portion that communicates with the central portion through the opening is disposed above the central portion.

18. A cylinder head assembly as set forth in claim 17 wherein the cylinder head is inclined so as to position the one portion above the central portion.

19. A cylinder head assembly as set forth in claim 1 wherein the opening is formed at the top of the one wall.

20. A method of forming a liquid cooled cylinder head assembly for an internal combustion engine comprising casting the cylinder head assembly to define in part a combustion chamber, exhaust port means extending from said combustion chamber through one side of said cylinder head and terminating in exhaust outlet means in one outer surface thereof, intake ports formed in the other side of said cylinder head assembly and extending from said intake inlet means formed in an outer surface thereof to said combustion chamber, said intake port means and said exhaust port means each being defined by respective internal walls of said cylinder head, a cooling jacket formed in said cylinder head and comprised of a central portion defined between said walls and in proximity to said combustion chamber, an inlet side portion formed between said intake port means wall and said other side of said cylinder head and an exhaust side portion formed in part by said exhaust port means wall and said one side of said cylinder head, said method comprising the step of machining an opening through an outer surface of said cylinder head assembly and through an upper portion of one of said walls for assisting in purging air from said cooling jacket by permitting air in an upper portion of said central portion to pass to the adjacent side portion, and closing the portion of the opening formed in the outer surface of the cylinder head.

* * * * *